United States Patent [19]

Zaweski et al.

[11] Patent Number: 4,626,259

[45] Date of Patent: Dec. 2, 1986

[54] FUEL COMPOSITIONS

[75] Inventors: Edward F. Zaweski; Leonard M. Niebylski, both of Baton Rouge, La.

[73] Assignee: Ethyl Corporation, Richmond, Va.

[21] Appl. No.: 793,585

[22] Filed: Oct. 31, 1985

[51] Int. Cl.[4] ..... C10L 1/26

[52] U.S. Cl. ..... 44/57; 44/76

[58] Field of Search ..... 44/57, 76

[56] References Cited

U.S. PATENT DOCUMENTS

| | | | |
|---|---|---|---|
| 2,280,217 | 4/1942 | Cloud | 44/57 |
| 2,785,662 | 3/1957 | Boyce | 44/57 |
| 3,060,121 | 10/1962 | Orloff et al. | 44/76 |
| 3,069,384 | 12/1962 | Coffield | 44/76 |

*Primary Examiner*—Y. Harris-Smith

*Attorney, Agent, or Firm*—Donald L. Johnson; John F. Sieberth; W. G. Montgomery

[57] ABSTRACT

Coking in and around the injector nozzles of indirect injection compression ignition engines is reduced by means of distillate fuel with which has been blended suitable concentrations of (i) organic nitrate ignition accelerator, and (ii) a sterically hindered 4,4'-thiobis phenol.

Also described are additive mixtures of (i) and (ii) for use in distillate fuels in amounts sufficient to reduce the coking tendencies of such fuels when used in the operation of indirect injection compression ignition engines.

11 Claims, 1 Drawing Figure

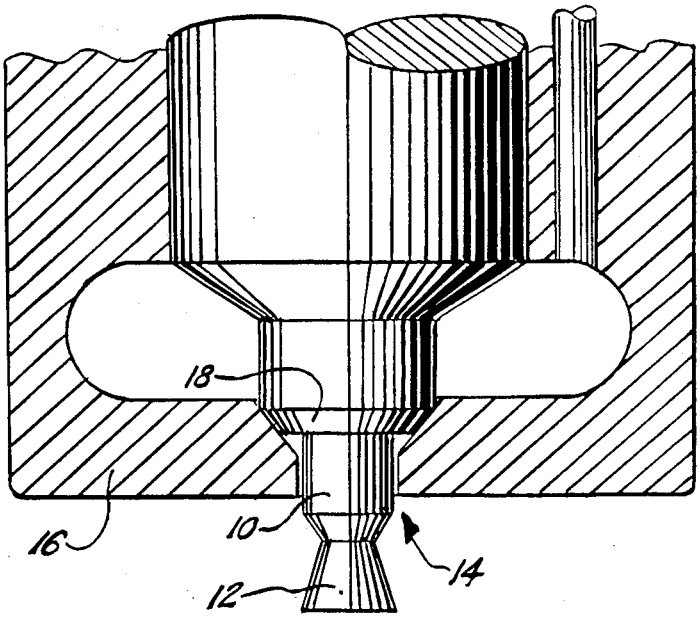
18
16
10
14
12

FUEL COMPOSITIONS

FIELD

This invention relates to compression ignition fuel compositions and additive mixtures of organic nitrate ignition accelerator and sterically hindered 4,4'-thiobis phenols in amounts sufficient to resist the coking tendencies of compression ignition fuel compositions when used in the operation of indirect injection diesel engines.

BACKGROUND

Throttling diesel nozzles have recently come into widespread use in indirect injection automotive and light-duty diesel truck engines, i.e., compression ignition engines in which the fuel is injected into and ignited in a prechamber or swirl chamber. In this way, the flame front proceeds from the prechamber into the larger compression chamber where the combustion is completed. Engines designed in this manner allow for quieter and smoother operation. The Figure of the Drawing illustrates the geometry of the typical throttling diesel nozzle (often referred to as the "pintle nozzle").

Unfortunately, the advent of such engines has given rise to a new problem, that of excessive coking on the critical surfaces of the injectors that inject fuel into the prechamber or swirl chamber of the engine. In particular and with reference to the Figure, the carbon tends to fill in all of the available corners and surfaces of the obturator 10 and the form 12 until a smooth profile is achieved. The carbon also tends to block the drilled orifice 14 in the injector body 16 and fill up to the seat 18. In severe cases, carbon builds up on the form 12 and the obturator 10 to such an extent that it interferes with the spray pattern of the fuel issuing from around the perimeter of orifice 14. Such carbon build-up or coking often results in such undesirable consequences as delayed fuel ignition, decreased rate of fuel injection, increased rate of combustion chamber pressure rise, increased engine noise, and can also result in an excessive increase in emission from the engine of unburned hydrocarbons.

While the composition of the low cetane number fuel is believed to be a major contributing factor to the coking problem, it is not the only relevant factor. Thermal and oxidative stability (lacquering tendencies), fuel aromaticity, and such fuel characteristics as viscosity, surface tension and relative density have also been indicated to play a role in the coking problem.

Thus, an important contribution to the art would be a fuel composition which has enhanced resistance to coking tendencies when employed in the operation of indirect injection diesel engines.

THE INVENTION

In keeping with the present invention, Applicants have discovered that the coking problem inherent in the use of distillate fuels in the operation of indirect injection compression diesel engines can be ameliorated by the addition to the fuel of an organic nitrate ignition accelerator and a sterically hindered 4,4'-thiobis phenol.

A wide variety of organic nitrate ignition accelerators may be employed in the fuels of this invention. Preferred nitrate esters are the aliphatic or cycloaliphatic nitrates in which the aliphatic or cycloaliphatic group is saturated, contains up to about 12 carbons and, optionally, may be substituted with one or more oxygen atoms.

Typical organic nitrates that may be used are methyl nitrate, ethyl nitrate, propyl nitrate, isopropyl nitrate, allyl nitrate, butyl nitrate, isobutyl nitrate, sec-butyl nitrate, tert-butyl nitrate, amyl nitrate, isoamyl nitrate, 2-amyl nitrate, 3-amyl nitrate, hexyl nitrate, heptyl nitrate, 2-heptyl nitrate, octyl nitrate, isooctyl nitrate, 2-ethylhexyl nitrate, nonyl nitrate, decyl nitrate, undecyl nitrate, dodecyl nitrate, cyclopentyl nitrate, cyclohexyl nitrate, methylcyclohexyl nitrate, cyclododecyl nitrate, 2-ethoxyethyl nitrate, 2-(2-ethoxy-ethoxy)-ethyl nitrate, tetrahydrofufuryl nitrate, and the like. Mixtures of such materials may also be used. The preferred ignition accelerator for use in the fuels of this invention is a mixture of octyl nitrates available as an article of commerce from Ethyl Corporation under the designation DII-3 Ignition Improver.

The sterically hindered 4,4'-thiobis phenols, component (ii), contemplated for use in the present invention are those compounds represented by the formula:

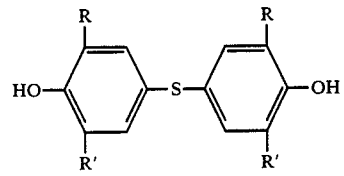

wherein R and R' are the same or different and are alkyl groups containing from 1 to 16 carbon atoms each. Preferably, the alkyl groups are branched on the alpha carbon atom.

Examples of the compounds of this invention include: 4,4'-thiobis(6-tert-butyl-o-cresol), 4,4'-thiobis(6-nonyl-o-cresol), 4,4'-thiobis(6-dodecyl-o-cresol), 4,4'-thiobis(6-hexadecyl-o-cresol), 4,4'-thiobis(2-ethyl-6-isopropylphenol), 4,4'-thiobis(2-isopropyl-6-sec-butylphenol), 4,4'-thiobis(2-isopropyl-6-tert-butylphenol), 4,4'-thiobis(2,6-di-tert-butylphenol), 4,4'-thiobis(2,6-di-sec-butylphenol), 4,4'-thiobis(2,6-diisopropylphenol), 4,4'-thiobis(2-dodecyl-6-ethylphenol), 4,4'-thiobis(2-dodecyl-6-isopropylphenol), 4,4'-thiobis(2-hexyl-6-isopropylphenol), 4,4'-thiobis(2-octyl-6-isopropylphenol), 4,4'-thiobis(2-dodecyl-6-isopropylphenol) and the like.

These compounds are known in the art and several methods for their preparation are also known. These compounds and methods for their preparation are disclosed, for example, in U.S. Pat. No. 3,326,800, incorporated herein by reference. Typically, these compounds can be prepared by reacting the parent phenolic compound with sulfur dichloride.

Thus, in one embodiment of the present invention there is provided distillate fuel for indirect injection compression ignition engines containing at least the combination of (i) organic nitrate ignition accelerator, and (ii) a sterically hindered 4,4'-thiobis phenol having the formula:

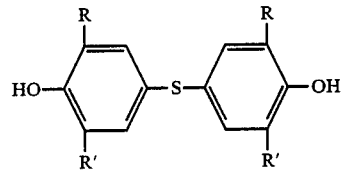

wherein R and R′ are the same or different and are alkyl groups containing from 1 to 16 carbon atoms each, said combination being present in an amount sufficient to minimize coking, especially throttling nozzle coking, in the prechambers or swirl chambers of indirect injection compression ignition engines operated on such fuel.

Since the invention also embodies the operation of an indirect injection compression ignition engine in a manner which results in reduced coking, a still further embodiment of the present invention is a method of inhibiting coking, especially throttling nozzle coking, in the prechambers or swirl chambers of an indirect injection compression ignition engine, which method comprises supplying said engine with a distillate fuel containing at least the combination of (i) organic nitrate ignition accelerator, and (ii) a sterically hindered 4,4′-thiobis phenol having the formula:

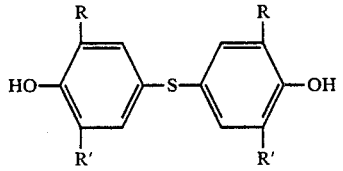

wherein R and R′ are the same or different and are alkyl groups containing from 1 to 16 carbon atoms each, said combination being present in an amount sufficient to inhibit such coking in an indirect injection compression ignition engine operated on such fuel.

The phenolic components of the invention should be used at a concentration of at least about 20 PTB (pounds per thousand barrels) to insure that the finished blend contains an adequate quantity of the foregoing ingredient although smaller amounts may be successfully employed.

The nitrate ignition accelerator, component (i), should be present in an amount of at least 100 to 1000 PTB (pounds per thousand barrels) of the base fuel. Preferably, the concentration of the ignition accelerator is about 400 to 600 PTB.

It is not believed that there is anything critical as regards the maximum amount of components (i) and (ii) used in the fuel. Thus, the maximum amount of these components will probably be governed in any given situation by matters of choice and economics.

The coking-inhibiting components (i) and (ii) of the invention can be added to the fuels by any means known in the art for incorporating small quantities of additives into distillate fuels. Components (i) and (ii) can be added separately or they can be combined and added together. It is convenient to utilize additive fluid mixtures which consist of organic nitrate ignition accelerator and the phenolic components of the invention. These additive fluid nitrates are added to distillate fuels. In other words, part of the present invention are coking inhibiting fluids which comprise organic nitrate ignition accelerator and the sterically hindered 4,4′-thiobis phenols described above.

Use of such fluids in addition to resulting in great convenience in storage, handling, transportation, blending with fuels, and so forth, also are potent concentrates which serve the function of inhibiting or minimizing the coking characteristics of compression ignition distillate fuels used to operate indirect compression ignition engines.

In these fluid compositions, the amount of components (i) and (ii) can vary widely. In general, the fluid compositions contain about 5 to 95% by weight of the organic nitrate ignition accelerator component and 5 to 95% by weight of the phenolic component. Typically, from about 0.01% by weight up to about 1.0% by weight of the combination will be sufficient to provide good coking-inhibiting properties to the distillate fuel. A preferred distillate fuel composition contains from about 0.1 to about 0.5% by weight of the combination containing from about 25% to about 95% by weight of the organic nitrate ignition accelerator and from about 75% to about 5% by weight of the alkylated phenolic component mixture.

The additive fluids, as well as the distillate fuel compositions of the present invention may also contain other additives such as corrosion inhibitors, antioxidants, metal deactivators, detergents, cold flow improvers, inert solvents or diluents, and the like.

Accordingly, a further embodiment of the invention is a distillate fuel additive fluid composition comprising (i) organic nitrate ignition accelerator, and (ii) a sterically hindered 4,4′-thiobis phenol having the formula:

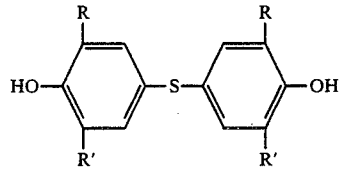

wherein R and R′ are the same or different and are alkyl groups containing from 1 to 16 carbon atoms each, in proportions sufficient to minimize the coking characteristics of such fuel, especially throttling nozzle coking in the prechambers or swirl chambers of indirect injection compression ignition engines operated on such fuel.

EXAMPLE I

In order to determine the effect of the fuel compositions of the present invention on the coking tendencies of diesel injectors in indirect injection compression ignition engines, use was made of a diesel fuel injector test apparatus developed for the purpose of screening chemical agents for use as anticoking, antideposit and antivarnish agents. The design of the apparatus allows it to accommodate any type of conventional automotive diesel fuel injector used in diesel engines such as the Bosch injectors used in turbocharged XD2S engines and the Lucus pencil-type or mini-fuel injectors used in 6.2 liter or 350 cu. in. diesel engines. The apparatus comprises a diesel fuel injector nozzle assembly attached to and extending into an aluminum cylinder 2.5 inches in width and 5.0 inches in diameter. Attached to and extending into the opposite side of the aluminum block is a 1-inch pipe assembly consisting of a connector nipple and tee which acts as a combination chamber into which diesel fuel is injected by the injector assembly. The chamber is coupled to a flash arrestor and exhaust-gas assembly. Also coupled to the combustion chamber is a serpentine-gas/air heater, 0.5 inches in diameter and 6.5 inches in length. The heater controls the temperature of the air entering the combustion chamber. If desired, air temperatures up to 750° C. can be produced. Under normal testing conditions, air temperature is maintained at a range between about 470° C. and 525° C.

Air flow rate, which is critical to the operation and replication of the test, is maintained by a mass flow controller to within 0.1 liter per minute at flow volumes of 20 to 50 liters per minute. A standard single cylinder diesel engine Bosch fuel pump is used to develop pressure and fuel volume passing into the injector. A 1-horsepower motor directly connected to the fuel pump is operated at 1750 RPM providing approximately 875 injections of fuel per minute. The fuel pump can be adjusted to provide fuel flow rates ranging from 35 milliliters to 3000 milliliters per hour. Standard operating fuel flow rates used for testing generally range between about 80 and 120 milliliters per hour. Under the standard operating conditions of air flow and fuel flow, incipient combustion of injected fuel occurs. Tests are carried out using 1-quart samples of fuel, with or without additives. The length of each test is four hours. After the test operation, the injectors are carefully removed from the apparatus so as not to disturb the deposits formed thereon.

After the test, the amount of deposit, coke or varnish on various areas of the injector external or internal parts are rated. Visual differences in amounts of deposits between a nonadditive test and one with an additive are used to distinguish and establish the effect of the chemical agent being tested as an anticoking additive. The areas of the injector parts which are rated for deposits include (i) the external area of the nozzle face, (ii) an area around the injector orifice extending one millimeter in diameter from the center of the orifice, (iii) the rim of the nozzle orifice, (iv) the exterior pintle tip, (v) the pintle obturator, and (vi) the nozzle face.

To demonstrate the anticoking effects of the present additives, a base fuel was prepared consisting of a commercially available diesel fuel having a nominal cetane rating of 37. FIA analysis indicated that the fuel was composed by volume of 41% aromatics, 2.0% olefins and 57% saturates. The base fuel also contained 140 pounds per thousand barrels (PTB) of mixed octyl nitrates (a commercial product available from Ethyl Corporation under the designation DII-3 Ignition Improver).

Test blends were prepared from this base fuel and were designated Fuels A and B. Fuel A contained, in addition to 140 PTB of mixed octyl nitrates, 50 PTB of 4,4'-thiobis(2,6-di-tert-butyl-phenol). Fuel B contained in addition to 140 PTB of mixed octyl nitrates, 50 PTB of 4,4'-thiobis(6-tert-butyl-o-cresol).

The diesel fuel injection test apparatus was operated for four hours on the base fuel followed by operation for four hours on the test blends (1-quart samples of each). Operating conditions for all tests were as follows:

Air Temperature . . . 510° C. to 520° C.

Air Flow Rate . . . 32.5 liters per minute

RPM . . . 1750

Fuel Flow Rate . . . 135 cubic centimeter/hour

Before each test, a new Bosch DNOSD-251 nozzle was installed in the apparatus.

After the tests, the injectors were carefully removed from the apparatus so as not to disturb the deposits formed thereon. Visual ratings of injector deposits were made with a deposit rating system in which 1=clean and 5=extreme deposit build-up.

The test results are given in Table I below:

TABLE I

| Fuel | Deposits on ext. area of injector nozzle face | Deposits within area 1 mm. in dia. from center of nozzle orifice | Deposits on rim of nozzle orifice | Deposits on external pintle tip | Deposits on pintle obturator | Deposits on nozzle face |
|---|---|---|---|---|---|---|
| Base | 3.5 | 3.5 | 2.5 | 3.5 | 2.5 | 4.0 |
| A | 3.5 | 3.0 | 1.8 | 3.0 | 1.7 | 3.0 |
| B | 3.5 | 3.0 | 2.0 | 4.0 | 2.2 | 3.0 |

The results presented in Table I indicate less coking deposits with Fuels A and B as compared to the Base Fuel.

We claim:

1. Distillate fuel for indirect injection compression ignition engines containing at least the combination of (i) organic nitrate ignition accelerator, and (ii) a sterically hindered 4,4'-thiobis phenol having the formula:

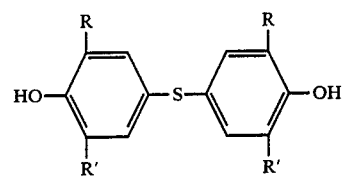

wherein R and R' are the same or different and are alkyl groups containing from 1 to 16 carbon atoms each, said combination being present in an amount sufficient to minimize the coking characteristics of such fuel, especially throttling nozzle coking in the prechambers or swirl chambers of indirect injection compression ignition engines operated on such fuel.

2. The composition of claim 1 wherein said ignition accelerator is a mixture of octyl nitrates.

3. The composition of claim 1 wherein said sterically hindered phenol is selected from 4,4'-thiobis(6-tert-butyl-o-cresol), 4,4'-thiobis(6-nonyl-o-cresol), 4,4'-thiobis(6-dodecyl-o-cresol), 4,4'-thiobis(6-hexadecyl-o-cresol), 4,4'-thiobis(2-ethyl-6-isopropylphenol), 4,4'-thiobis(2-isopropyl-6-sec-butylphenol), 4,4'-thiobis(2-isopropyl-6-tert-butylphenol), 4,4'-thiobis(2,6-di-tert-butylphenol), 4,4'-thiobis(2,6-di-sec-butylphenol), 4,4'-thiobis(2,6-diisopropylphenol), 4,4'-thiobis(2-docecyl-6-ethylphenol), 4,4'-thiobis(2-dodecyl-6-isopropylphenol), 4,4'-thiobis(2-hexyl-6-isopropylphenol), 4,4'-thiobis(2-octyl-6-isopropylphenol), and 4,4'-thiobis(2-dodecyl-6-isopropylphenol).

4. A method of inhibiting coking, especially throttling nozzle coking, in the prechambers or swirl chambers of an indirect injection compression ignition engine, which method comprises supplying said engine with a distillate fuel containing at least the combination of (i) organic nitrate ignition accelerator, and (ii) a sterically hindered 4,4'-thiobis phenol having the formula:

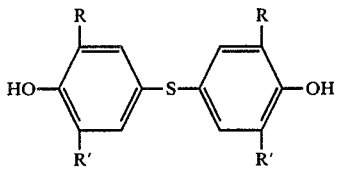

wherein R and R′ are the same or different and are alkyl groups containing from 1 to 16 carbon atoms each, said combination being present in an amount sufficient to inhibit such coking in an indirect injection compression ignition engine operated on such fuel.

5. The method of claim 4 wherein said ignition accelerator is a mixture of octyl nitrates.

6. The method of claim 4 wherein said sterically hindered phenol is selected from 4,4′-thiobis(6-tert-butyl-o-cresol), 4,4′-thiobis(6-nonyl-o-cresol), 4,4′-thiobis(6-dodecyl-o-cresol), 4,4′-thiobis(6-hexadecyl-o-cresol), 4,4′-thiobis(2-ethyl-6-isopropylphenol), 4,4′-thiobis(2-isopropyl-6-sec-butylphenol), 4,4′-thio-bis(2-isopropyl-6-tert-butylphenol), 4,4′-thiobis(2,6-di-tert-butylphenol), 4,4′-thiobis(2,6-di-sec-butylphenol), 4,4′-thiobis(2,6-diisopropylphenol), 4,4′-thiobis(2-docecyl-6-ethylphenol), 4,4′-thiobis(2-dodecyl-6-isopropyl phenol), 4,4′-thiobis(2-hexyl-6-isopropylphenol), 4,4′-thiobis(2-octyl-6-isopropylphenol), and 4,4′-thiobis(2-dodecyl-6-isopropylphenol).

7. An additive fluid concentrate for use in distillate fuels containing at least the combination of (i) organic nitrate ignition accelerator, and (ii) a sterically hindered 4,4′-thiobis phenol having the formula:

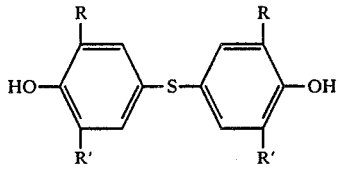

wherein R and R′ are the same or different and are alkyl groups containing from 1 to 16 carbon atoms each, said combination being present in proportions sufficient to minimize the coking characteristics of such fuel, especially throttling nozzle coking in the prechambers or swirl chambers of indirect injection compression ignition engines operated on such fuel.

8. A concentrate of claim 7 comprising about 5 to 95% by weight of said organic nitrate ignition accelerator and about 5 to 95% by weight of said sterically hindered phenol.

9. A concentrate of claim 7 wherein said ignition accelerator is a mixture of octyl nitrates.

10. A concentrate of claim 7 wherein said sterically hindered phenol is selected from 4,4′-thiobis(6-tert-butyl-o-cresol), 4,4′-thiobis(6-nonyl-o-cresol), 4,4′-thiobis(6-dodecyl-o-cresol), 4,4′-thiobis(6hexadecyl-o-cresol), 4,4′-thiobis(2-ethyl-6-isopropylphenol), 4,4′-thiobis(2-isopropyl-6-sec-butylphenol), 4,4′-thiobis(2-isopropyl-6-tert-butylphenol), 4,4′-thiobis(2,6-di-tert-butylphenol), 4,4′-thiobis(2,6-di-sec-butylphenol), 4,4′-thiobis(2,6-diisopropylphenol), 4,4′-thiobis(2-docecyl-6-ethylphenol), 4,4′-thiobis(2-dodecyl-6-isopropylphenol), 4,4′-thiobis(2-hexyl-6-isopropylphenol), 4,4′-thiobis(2-octyl-6-isopropylphenol), and 4,4′-thiobis(2-dodecyl-6-isopropylphenol).

11. An additive fluid concentrate comprising about 5 to 95% by weight of a mixture of octyl nitrates and from about 5 to 95% by weight of 4,4′-thiobis(2,6-di-tert-butylphenol).

* * * * *

UNITED STATES PATENT AND TRADEMARK OFFICE

CERTIFICATE OF CORRECTION

PATENT NO. : 4,626,259

DATED : DECEMBER 2, 1986

INVENTOR(S) : EDWARD F. ZAWESKI and LEONARD M. NIEBYLSKI

It is certified that error appears in the above-identified patent and that said Letters Patent is hereby corrected as shown below:

Column 3, line 55, reads "nitrates" and should read -- mixtures --.

Column 4, line 59, reads "combination" and should read -- combustion --.

Column 7, line 26, reads "thio-bis" and should read -- thiobis --.

Column 7, lines 31-32, reads "4,4'-thiobis(2-dodecyl-6-isopropyl phenol)" and should read -- 4,4'-thiobis(2-dodecyl-6-isopropylphenol) --.

Signed and Sealed this

Fifteenth Day of September, 1987

*Attest:*

*Attesting Officer*

DONALD J. QUIGG

*Commissioner of Patents and Trademarks*